United States Patent [19]

Johnston

[11] Patent Number: 4,869,493

[45] Date of Patent: Sep. 26, 1989

[54] TREADMILL ASSOCIATED EXERCISE APPARATUS

[76] Inventor: Gary L. Johnston, 19251 Preston Rd. #1402, Dallas, Tex. 75252

[21] Appl. No.: 274,549

[22] Filed: Nov. 22, 1988

[51] Int. Cl.[4] ..... A63B 23/06; A63B 21/26

[52] U.S. Cl. ..... 272/69; 272/134; 272/131

[58] Field of Search ..... 272/69, 72, 116, 128, 272/131, 132, 133, 134; 198/859, 833, 832

[56] References Cited

U.S. PATENT DOCUMENTS

| | | | |
|---|---|---|---|
| 641,596 | 1/1900 | Kerns | 272/72 |
| 1,793,158 | 2/1931 | Clayton | 198/859 X |
| 2,679,852 | 6/1954 | Erie | 198/859 X |
| 2,781,945 | 2/1957 | Skold | 198/859 X |
| 4,796,748 | 1/1989 | Manning | 198/859 X |

FOREIGN PATENT DOCUMENTS

| | | | |
|---|---|---|---|
| 8800850 | 2/1988 | Canada | 272/69 |
| 560096 | 9/1932 | Fed. Rep. of Germany | 198/859 |
| 983237 | 2/1965 | United Kingdom | 198/859 |
| 2131308 | 6/1984 | United Kingdom | 272/131 |

*Primary Examiner*—Richard J. Apley
*Assistant Examiner*—H. Flaxman
*Attorney, Agent, or Firm*—Henderson & Sturm

[57] ABSTRACT

A treadmill associated exercise apparatus (10) including a conventional treadmill unit (11) provided with a pair of guide rails (18) which are operatively associated with a force transmitting member (21); wherein the force transmitting member (21) is attached to a releasable grasping structure (22) that will selectively engage the treadmill belt element (14) when the force transmitting member (21) is moved in one direction; and, wherein the releasable grasping means will become disengaged from the treadmill belt element (14) when the force transmitting structure (21) is moved in an opposite direction.

6 Claims, 2 Drawing Sheets

FIG. 1.
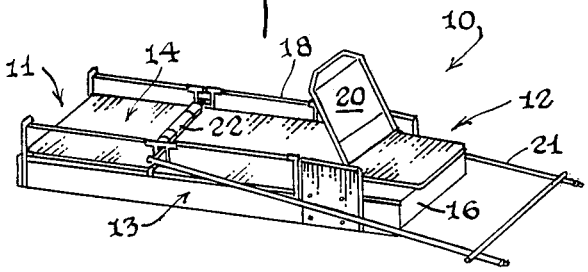
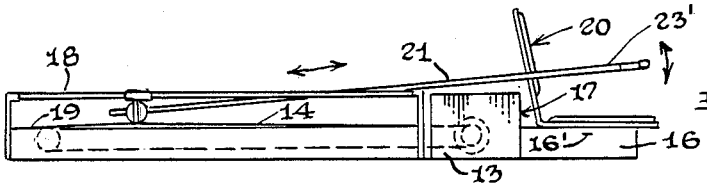
FIG. 2.
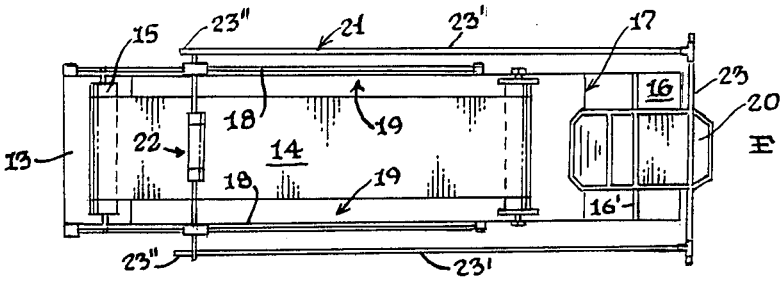
FIG. 3.
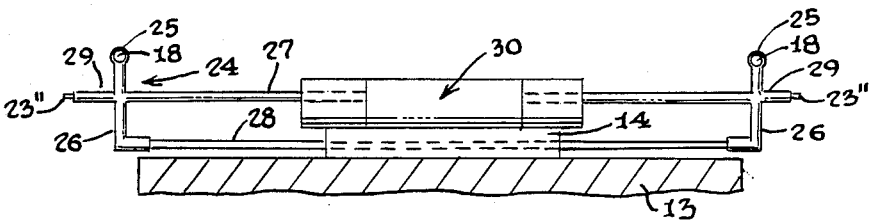
FIG. 4.
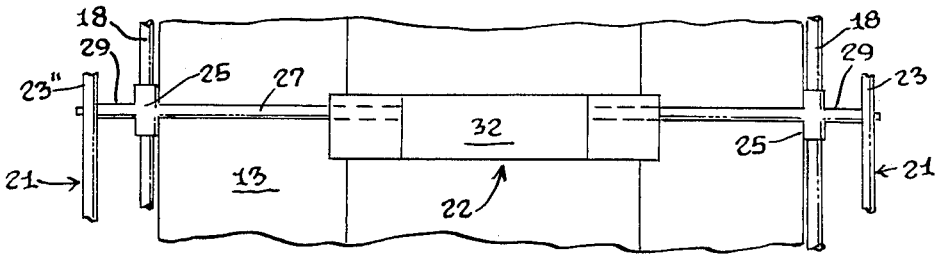
FIG. 5.

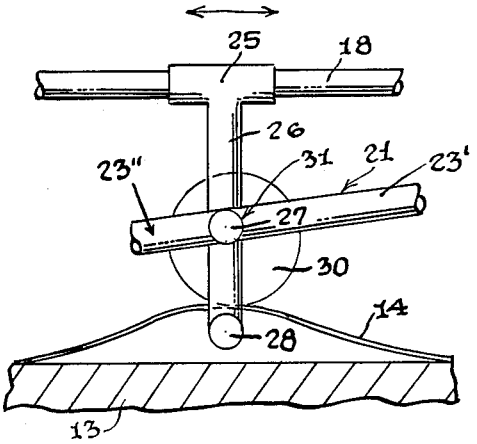
FIG. 6.
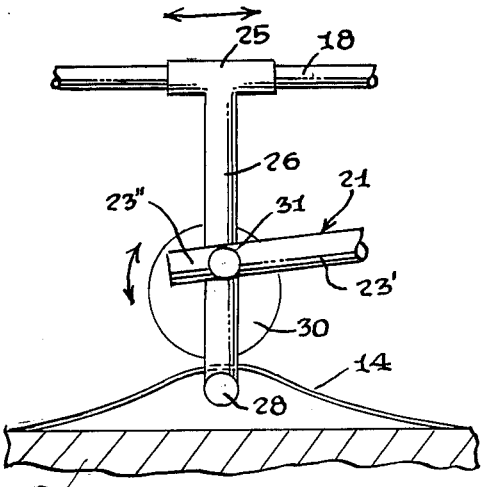
FIG. 7.
FIG. 8.
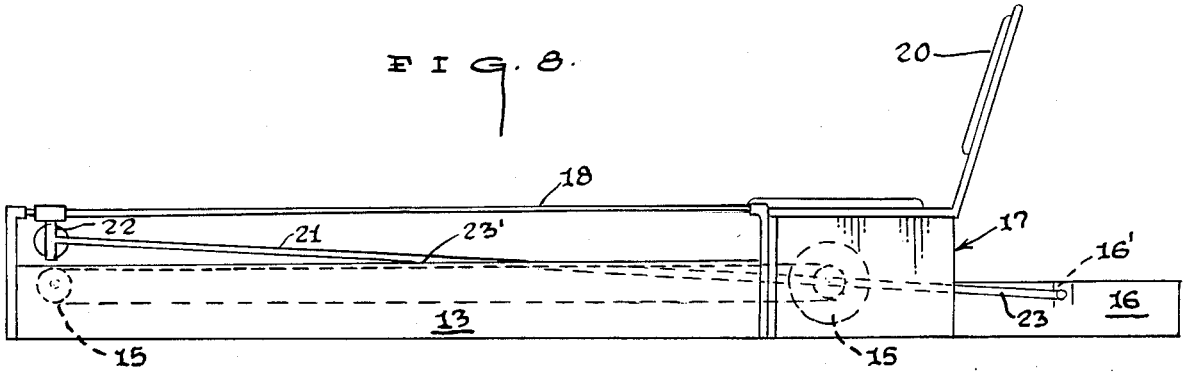
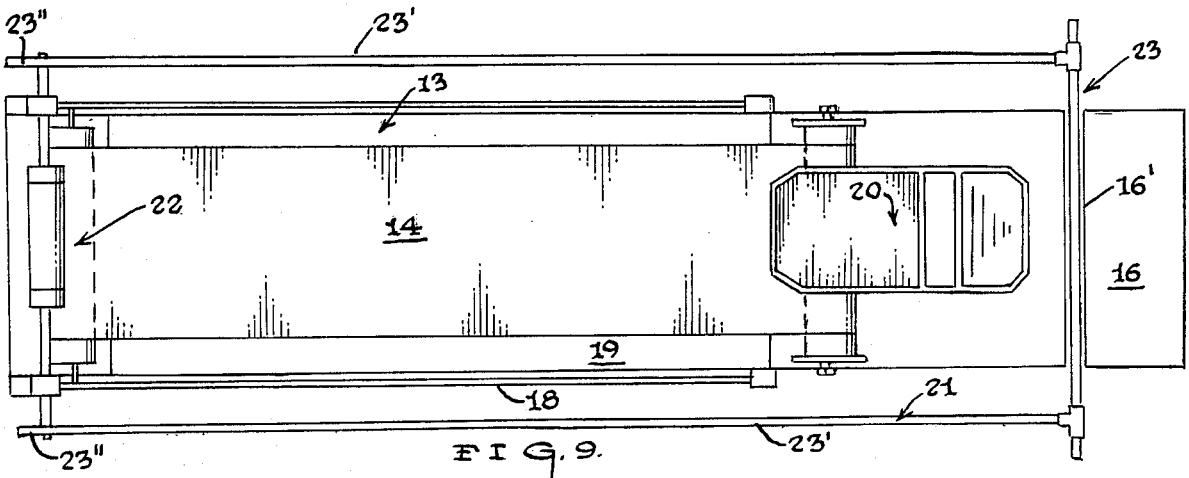
FIG. 9.

TREADMILL ASSOCIATED EXERCISE APPARATUS

TECHNICAL FIELD

The present invention relates in general to a treadmill exercise device, and in particular to a treadmill associated exercise device which performs two distinct exercising operations and which is operated in general from a seated position.

BACKGROUND OF THE INVENTION

As can be seen by reference to the following U.S. Pat. Nos.: 2,315,485; 3,193,287; 3,870,297; 4,566,689; 4,625,962; 4,632,385; 4,679,787; and 4,729,558 the prior art is replete with myriad and diverse treadmill based exercise apparatus.

While the prior art constructions are more than adequate for the purpose and function for which they were specifically designed, they do suffer from a number of shared deficiencies.

To begin with, all of the aforementioned prior art constructions are devoted solely to lower body treadmill type exercise devices. In addition, none of the prior art devices either envision an upper body exercise adjunct to a treadmill apparatus; or, the use of the treadmill bed as a power take off or a resistance means for an upper body exercising device.

Given the fact that there are vast members of specialized exercising apparatus, it comes as somewhat of a surprise that, to date no one has effectively combined a lower body and upper body exercise apparatus that works primarily off of the treadmill portion of the combined apparatus.

SUMMARY OF THE INVENTION

Briefly stated, the exercise apparatus that forms the basis of the present invention comprises a conventional treadmill unit and an auxiliary upper body exercise unit which is operatively connected to the treadmill unit.

The treadmill unit comprises a conventional treadmill member having a generally rectangular treadmill base framework element which supports a treadmill belt element in a well recognized fashion.

The auxiliary upper body exercise unit comprises in general: an extension member that is operatively attached to the front of the treadmill base framework element; guide rails attached to the top of the sides of the treadmill base framework; a seat member selectively positionable on either the treadmill base framework or the extension member; and, a force transmitting member that is operatively attached to both the treadmill belt element and the guide rails.

In addition, as will be explained in greater detail further on in the specification the force transmitting member is provided with a releasable grasping means that will frictionally engage the treadmill belt element when the force transmitting member is moved in one direction and which become disengaged from the treadmill belt element when the force transmitting member is moved in the opposite direction.

Furthermore, the releasable grasping means is also provided with a reversing mechanism whereby the direction of engagement between the force transmitting member and the treadmill belt element may be reversed.

BRIEF DESCRIPTION OF THE DRAWINGS

These and other objects, advantages, and novel features of the invention should become apparent from the detailed description of the best mode for carrying out the preferred embodiment of the invention which follows; particularly when considered in conjunction with the accompanying drawings, wherein:

FIG. 1 is a perspective view of the treadmill associated exercise apparatus of this invention;

FIG. 2 is a side plan view of the exercise apparatus;

FIG. 3 is a top plan view of the apparatus;

FIG. 4 is an isolated end view of the releasable grasping means of the apparatus;

FIG. 5 is an isolated top plan view of the releasable grasping means;

FIG. 6 is an enlarged side view of the releasable grasping means in one mode of operation;

FIG. 7 is an enlarged side view of the releasable grasping means in another mode of operation;

FIG. 8 is a side plan view of the apparatus in an alternate mode of deployment; and, FIG. 9 is a top plan view of the apparatus in the alternate mode of deployment.

BEST MODE FOR CARRYING OUT THE INVENTION

As can best be seen by reference to the drawings and in particular to FIG. 1, the exercise apparatus that forms the basis of the present invention is designated generally by the reference numeral (10). The exercise apparatus (10) comprises in general: a conventional treadmill unit (11) and an auxiliary upper body exercise unit (12). These units will now be described in seriatim fashion.

As shown in FIGS. 1 thru 3, the conventional treadmill unit (11) comprises in general: a treadmill base framework (13) equipped with a treadmill belt element (14) which is supported by roller elements (15) in a well recognized manner.

As can be seen by reference to FIGS. 1 thru 3, 8, and 9, the upper body exercise unit comprises in general: an extension member (16) that is operatively associated with the front (17) of the treadmill base framework (13); a pair of guide rails (18) attached to the top (19) of the elongated sides of the treadmill base framework (13); a seat member (20); and force transmitting member (21) provided with releasable grasping means (22).

As can best be seen by reference to FIGS. 2, 3, 8 and 9, the extension member (16) has a generally rectangular configuration and is further provided with a shallow recess (16') which is disposed generally parallel to the front (17) of the treadmill base framework (13). In addition, the seat member (20) may be optionally positioned on either the extension member (16) in a forward facing direction or on the top of the treadmill base framework (13) in a rearward facing direction; and, this alternate seating arrangement will be explained in greater detail further on in the specification.

Still referring to FIGS. 2, 3, 8 and 9, it can be seen that the force transmitting member (21) comprises an elongated generally U-shaped tubular element (23); wherein the legs (23') of the tubular element (23) exceed the length of the treadmill base framework (13); and, wherein the ends (23'') of the legs (23') of the tubular element (23) are operatively connected to the releasable grasping means (22).

Turning now to FIGS. 4 thru 7, it can be seen that the releasable grasping means (22) comprises a pair of generally tubular coupling member (24); wherein, each coupling member (24) has an upper generally hollow cylindrical rail engaging element (25) having a downwardly depending stem element (26); wherein, each of the downwardly depending stem elements are operatively attached to one end of an upper stationary axle member (27) and a removable lower support rod member (28) which is mounted for rotary movement relative to the respective stem elements (26).

In addition, as can best be seen by reference to FIGS. 4 and 5, the upper stationary axle member (27) is provided with outwardly projecting arm elements (29) which are operatively connected to the ends (23″) of the legs (23′) of the force transmitting member (21); wherein, the force transmitting member (21) is adapted to reciprocate the releasable grasping means (22) along the guide rails (18) relative to the treadmill unit (11) in a well recognized manner.

Still referring to FIGS. 4 thru 7, it can be seen that the releasable grasping means (22) further comprises a press cylinder member (30) operatively and rotatably secured in a axially offset fashion relative to the upper axle member (27); wherein, the cylinder member (30) is provided with an axially offset elongated aperture (31) which is dimensioned to receive the upper axle member (27). Furthermore, the press cylinder member (30) is also provided a high friction coating (32) such as rubber or the like to enhance the frictional engagement between the press cylinder member and the treadmill belt element (14) as will be explained presently.

As can be appreciated particularly by reference to FIGS. 4, 6 and 7, the upper axle member (27) and the press cylinder member (30) are adapted to contact the upper surface of the treadmill belt element (14); while the lower support rod member (28) is adapted to lift and support the underside of the treadmill belt element.

Given the axially offset relationship of the press cylinder member (30) relative to the upper axle member (27) it can be appreciated that when the press cylinder (30) is disposed on the right hand side of the stem element (26) movement of the force transmitting member (21) to the right will cause the press cylinder to pinch the treadmill belt element (14) against the lower support rod element (28) to offer resistance to the user. On the other hand, movement of the force transmitting member to the left will disengage the press cylinder from tight frictional engagement with the treadmill belt element (14) and offer very minimal resistance to the user.

In addition, when the user wishes to reverse the direction of force resistance provided by releasable grasping means (21); all that is required is the rotation of the press cylinder (30) counterclockwise about the upper axle member (27) such that the press cylinder is disposed on the left side of the stem element (26). Once this is accomplished the press cylinder member (30) will pinch the treadmill belt element (14) when the force transmitting member (21) is moved to the left and the press cylinder member (30) will release the treadmill belt element (14) when the force transmitting member (21) is moved to the right.

By now it should be appreciated that in the preferred mode of deployment of the exercise apparatus (10) the user places the seat member (20) in the forward facing direction depicted in FIGS. 1 thru 3, and reciprocates the force transmitting member (21) back and forth relative to the treadmill unit (11) whereby the releasable grasping means (21) will offer resistance in a selected one of the forward and backward reciprocal movements.

However, in an alternate mode of deployment of the exercise apparatus (10) depicted in FIGS. 8 and 9, the seat member (20) may be moved to a rearward facing direction on top of the treadmill base framework (13) such that the user may place their feet on the treadmill to perform lower body exercises. The support rod (28) may then be removed so that the belt (14) makes full contact with the treadmill base (13). At this point, the press cylinder member (30) will no longer come in contact with the belt (14). In addition, in this latter mode of deployment the releasable grasping means (21) is translated rearwardly along the guide rails (18) such that the forward end of the generally U-shaped tubular framework (23) of the force transmitting member (21) will rest in the shallow recess (16′) of the extension member (16).

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A treadmill associated exercise apparatus wherein the exercise apparatus comprises:

a conventional treadmill unit having a treadmill base framework and a treadmill belt element; and, an auxiliary exercise unit comprising: a pair of guide rails disposed along the sides of the treadmill base framework; a user engagable force transmitting member operatively associated with said guide rails; and a releasable grasping means operatively associated with the guide rails, the force transmitting member such that the grasping means engages the treadmill belt element and when the force transmitting member is moved in one direction and releases the treadmill belt element when the force transmitting member is moved in a direction opposite to said one direction.

2. The exercise apparatus as in claim 1 wherein the releasable grasping means comprises:

a pair of generally tubular coupling members wherein each coupling member is provided with a guide rail engaging element having a downwardly depending stem element that is operatively connected to said force transmitting member.

3. The exercise apparatus as in claim 2 wherein the pair of coupling members are further provided with: an upper axle member that is disposed above the treadmill belt element; and, a lower support rod member which is disposed underneath the treadmill belt element.

4. The exercise apparatus as in claim 3 wherein the upper axle member is further provided with an axially offset press cylinder member which is adapted to be brought into tight frictional engagement with the upper surface of said treadmill belt element when the force transmitting member is moved in said one direction.

5. The exercise apparatus as in claim 4 wherein the lower support rod member is adapted to lift and support the underside of said treadmill belt element.

6. The exercise apparatus as in claim 5 further comprising:

an extension member that is operatively associated with the front of said treadmill framework base; and, a seat member that may be selectively disposed on the extension member and the top of the treadmill framework base.

* * * * *